US009074499B2

(12) United States Patent
Woo et al.

(10) Patent No.: US 9,074,499 B2
(45) Date of Patent: Jul. 7, 2015

(54) MULTIPLE VARIABLE VALVE LIFT APPARATUS AND ENGINE PROVIDED WITH THE SAME

(71) Applicant: Hyundai Motor Company, Seoul (KR)

(72) Inventors: Soo Hyung Woo, Youngin-si (KR); Chang Ho Yang, Osan-si (KR); Young Hong Kwak, Suwon-si (KR); Byong Young Choi, Bucheon-si (KR); Jin Kook Kong, Suwon-si (KR); Gee Wook Shin, Ansan-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/098,375

(22) Filed: Dec. 5, 2013

(65) Prior Publication Data

US 2014/0165940 A1 Jun. 19, 2014

(30) Foreign Application Priority Data

Dec. 18, 2012 (KR) ..... 10-2012-0148752

(51) Int. Cl.
*F01L 1/34* (2006.01)
*F01L 13/00* (2006.01)

(52) U.S. Cl.
CPC ..... *F01L 13/0005* (2013.01); *F01L 13/0036* (2013.01); *F01L 2013/0052* (2013.01); *F01L 2820/031* (2013.01)

(58) Field of Classification Search
CPC ..... F01L 13/0005; F01L 13/0036; F01L 2820/031; F01L 2013/0052
USPC ..... 123/90.15, 90.16, 90.18
See application file for complete search history.

(56) References Cited

U.S. PATENT DOCUMENTS

| | | | | |
|---|---|---|---|---|
| 4,404,937 | A | 9/1983 | Leitermann | |
| 5,048,474 | A * | 9/1991 | Matayoshi et al. | 123/90.18 |
| 6,425,359 | B2 | 7/2002 | Fujii et al. | |
| 7,409,938 | B2 | 8/2008 | Dengler | |
| 7,472,671 | B2 | 1/2009 | Elendt et al. | |
| 2007/0178731 | A1 | 8/2007 | Elendt | |

FOREIGN PATENT DOCUMENTS

| | | | |
|---|---|---|---|
| DE | 42 30 877 | A1 | 4/1993 |
| DE | 101 48 243 | A1 | 4/2003 |
| EP | 0 798 451 | A1 | 10/1997 |
| JP | 2010-96102 | A | 4/2010 |

* cited by examiner

*Primary Examiner* — Zelalem Eshete
(74) *Attorney, Agent, or Firm* — Morgan, Lewis & Bockius LLP

(57) ABSTRACT

A multiple variable valve lift apparatus may include a camshaft, a plurality of cams slidably fitted on the camshaft and each having a cam base with a guide groove and a cam lobe, a solenoid valve including an actuating rod capable of being selectively inserted into the guide groove of a cam in the plurality of cams, and a valve opening/closing unit capable of selectively coming in contact with any cam in the plurality of cams.

10 Claims, 6 Drawing Sheets

FIG. 6

| Ten stages | Lift at valve 1 | lift at valve 2 | Implemented engine |
|---|---|---|---|
| 1 | 0 | 0 | CDA implemented |
| 2 | 0 | 2 | Minimum amount of air such as idle |
| 3 | 0 | 10 | High swirl |
| 4 | 0 | 0 | Swirl |
| 5 | 5 | 2 | Swirl |
| 6 | 5 | 10 | Swirl |
| 7 | 5 | 0 | High swirl |
| 8 | 8 | 2 | High swirl |
| 9 | 8 | 10 | Performance |
| 10 | 10 | 10 | Performance |

MULTIPLE VARIABLE VALVE LIFT APPARATUS AND ENGINE PROVIDED WITH THE SAME

CROSS-REFERENCE TO RELATED APPLICATION

The present application claims priority of Korean Patent Application Number No. 10-2012-0148752 filed Dec. 18, 2012, the entire contents of which application are incorporated herein for all purposes by this reference.

BACKGROUND OF INVENTION

1. Field of Invention

The present invention relates to a multiple variable valve lift apparatus and an engine including the same. More particularly, the present invention relates to a multiple variable valve lift apparatus that can implement a plurality of valve lift modes with a simple configuration, and an engine including the apparatus.

2. Description of Related Art

Internal combustion engines generate power by receiving and burning air and fuel in a combustion chamber. When air is sucked, an intake valve is operated by a camshaft and air is sucked into the combustion chamber while the intake valve is open. Further, an exhaust valve is operated by the camshaft and air is discharged from the combustion chamber while the exhaust valve is open.

The optimum operation of the intake valve/exhaust valve, however, depends on the RPM of the engine. That is, an appropriate time for a lift or valve opening/closing depends on the RPM of the engine. In order to implement an appropriate valve operation in accordance with the RPM of the engine, as described above, a VVL (Variable Valve Lift) apparatus having a plurality of shapes of cam operating valves or operating valves at different lifts in accordance with the RPM of an engine has been studied.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide a multiple variable valve lift apparatus having advantages of being able to implement a plurality of valve lift modes with a simple configuration, and an engine including the apparatus.

Various aspects of the present invention provide a multiple variable valve lift apparatus that may include a camshaft, a plurality of cams slidably fitted on the camshaft and each having a cam base with a guide groove and a cam lobe, a solenoid valve including an actuating rod capable of being selectively inserted into the guide groove of a cam in the plurality of cams, and a valve opening/closing unit capable of selectively coming in contact with any cam in the plurality of cams.

The cams, the solenoid valve, and the valve opening/closing unit may constitute one variable valve unit, and two variable valve units may be provided for one or each cylinder. The variable valve units of the cylinder may have different numbers of cams. The cams of the variable valve units may have cam lobes that are different in lift and the cams are arranged in order of size.

At least one of the cams in one of the two variable valve units provided for the cylinder may have a cam lobe that is different in lift than any cam in the other variable valve unit. One cam in the variable valve units may have a cam lobe with a lift of zero (0). The variable valve units of the cylinder may operate independently from each other.

The guide groove of one or each cam in the variable valve unit may be formed at an angle to connect the cam bases of adjacent cams, and the guide groove may include an operation guide groove to move the cam in one direction and a reverse guide groove to move the cam in an opposite direction.

For a cam disposed at an end in the variable valve unit, a start of the operation guide groove of the cam may be formed on a same circumference as an end of the reverse guide groove of the cam, and an end of the operation guide groove of the cam may be formed on a same circumference as a start of the reverse guide groove of an adjacent cam.

For a cam disposed inside of the variable valve unit, a start of the operation guide groove of the cam may be formed on a first circumference that is the same as an end of the operation guide groove of an adjacent cam, and a start of the reverse guide groove of the cam may be formed on a second circumference that is the same as an end of the reverse guide groove of another adjacent cam, wherein the first and second circumferences are different.

The valve opening/closing unit may include a roller that comes in contact with any selected cam in the plurality of cams. An engine may be equipped with any of the multiple variable valve lift apparatus of the present invention.

According to various aspects of the present invention, it is possible to implement a plurality of valve lift modes with a simple configuration.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIG. 6 is a diagram illustrating operation modes of an exemplary multiple variable valve lift apparatus according to the present invention.

DETAILED DESCRIPTION

Figure 1:
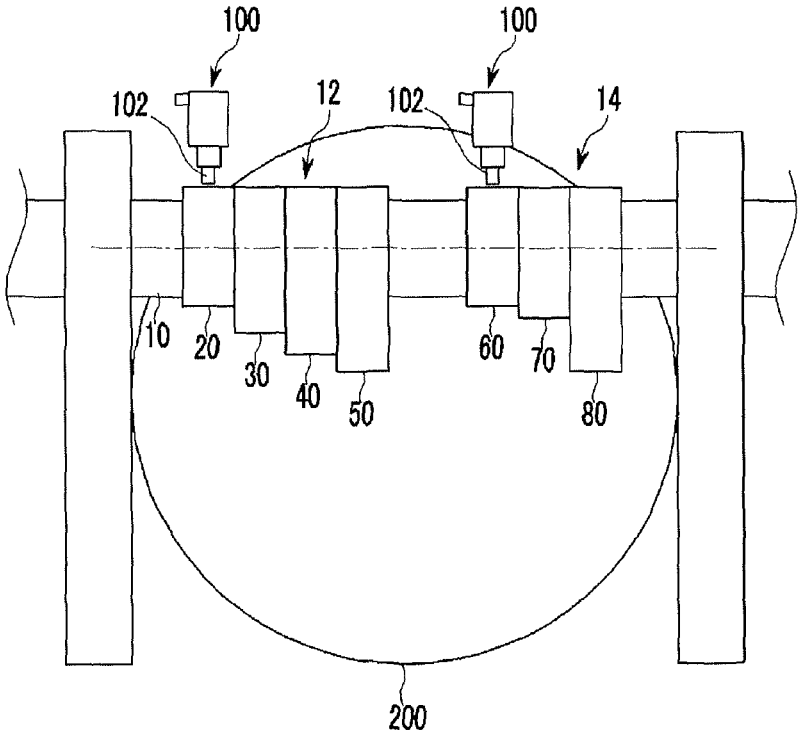
FIG. 1 is a view showing an exemplary multiple variable valve lift apparatus according to the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration. As those skilled in the art would realize, the described embodiments may be modified in various different ways, all without departing from the spirit or scope of the present invention. Like reference numerals are given to like components throughout the specification. In the drawings, the thickness of layers, films, panels, regions, etc., may be exaggerated for clarity.

The case in which it is represented that each part such as a layer, a film, an area, a plate, or the like, is "on" another part is intended to include not only the case in which each part is "directly on", but also the case in which the other part is between each part and another part. In contrast, when an element is referred to as being "directly on" another element, there are no intervening elements present. Throughout the specification, unless explicitly described to the contrary, the word "comprise" and variations such as "comprises" or "comprising", will be understood to imply the inclusion of stated elements but not the exclusion of any other elements.

Figure 2:
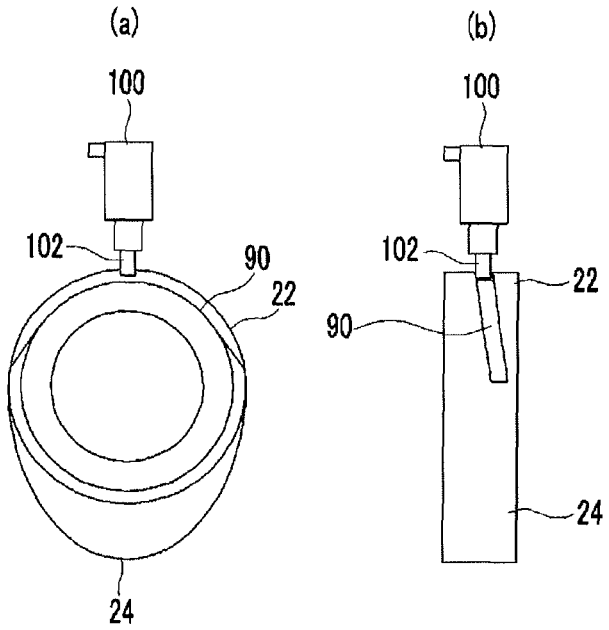
FIG. 2 is a view showing one cam and one solenoid valve of an exemplary multiple variable valve lift apparatus according to the present invention.
Figure 3:
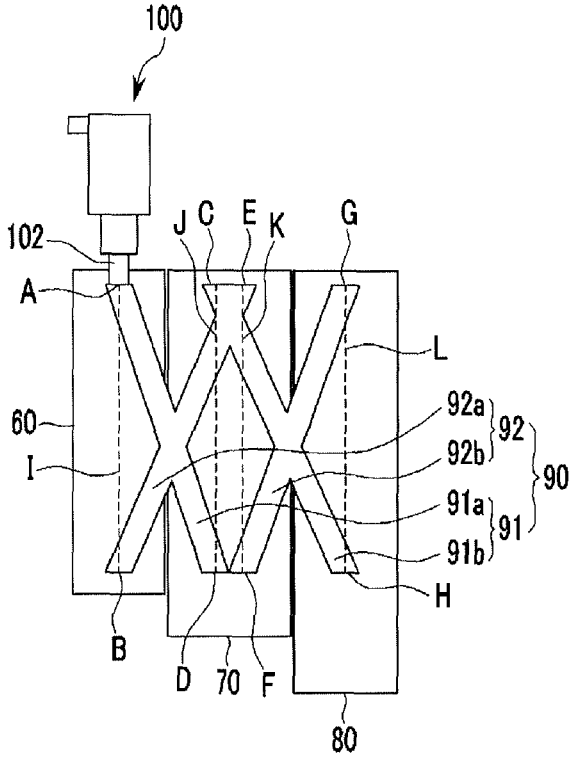
FIG. 3 is a view showing an exemplary cam and an exemplary solenoid valve of an exemplary multiple variable valve lift apparatus according to the present invention.
Figure 4:
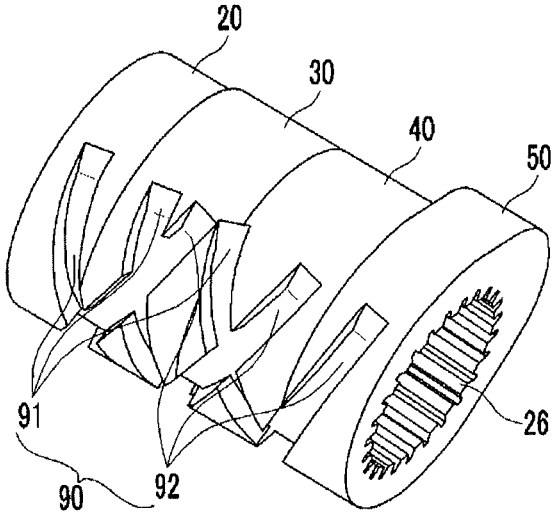
FIG. 4 is a perspective view showing an exemplary cam of an exemplary multiple variable valve lift apparatus according to the present invention.

FIG. 1 is a view showing a multiple variable valve lift apparatus, FIG. 2 is a view showing one cam and one solenoid valve of a multiple variable valve lift apparatus, FIG. 3 is a view showing a cam and a solenoid valve of a multiple variable valve lift apparatus, and FIG. 4 is a perspective view showing a cam of a multiple variable valve lift apparatus, according to various embodiments of the present invention.

Referring to FIGS. 1 to 4, a multiple variable valve lift apparatus may include a camshaft 10, a plurality of cams 20, 30, 40, 50, 60, 70, and 80 slidably fitted on the cam shaft 10 and each having a cam base 22 with a guide groove 90 and a cam lobe 24, solenoid valves 100 including an actuating rod 102 that is selectively inserted in the guide groove 90, and a valve opening/closing unit 110 (see FIG. 5) selectively coming in contact with any one of the cams 20, 30, 40, 50, 60, 70, and 80. The cams 20, 30, 40, 50, 60, 70, and 80 are referred to as first, second, third, fourth, fifth, sixth, and seventh cams hereafter for better comprehension and ease of description.

For a cam such as cam 20 shown in FIG. 2 as an example, the guide groove 90 is formed at the cam base 22, and as the solenoid valve 100 operates and the actuating rod 102 is inserted into the guide groove 90 of the cam 20, the cam 20 slides on the cam shaft 10. The actuating rod 102 returns from the end of the guide groove 90 that turns.

A plurality of cams, such as cams 20, 30, 40, and 50 or cams 60, 70, and 80, the solenoid valve 100, and the valve opening/closing unit 110 constitute one variable valve unit 12 or 14 and each cylinder may be provided with two variable valve units 12 and 14. That is, as shown in FIG. 1, one cylinder 200 may be equipped with the first variable valve unit 12 and the second variable valve unit 14.

Any one of the variable valve units of the cylinder 200 may operate independently from or simultaneously with the other variable valve unit. That is, the first valve unit 12 and the second valve unit 14 not only can operate one at a time, independently from the other, but also can operate simultaneously.

FIG. 3 shows the second variable valve unit 14, which is exemplified in the following description. The guide grooves 90 are formed at an angle to connect the cam bases of the fifth, sixth, and seventh cams 60, 70, and 80 that are adjacent to each other and each has an operation guide groove 91 formed to move the fifth, sixth, and seventh cams 60, 70, and 80 in any one direction and a reverse guide groove 92 formed in the opposite direction.

That is, the first operation guide groove 91*a* connects the fifth and sixth cams 60 and 70 and the second operation guide groove 91*b* connects the sixth and seventh cams 70 and 80. Further, the first reverse guide groove 92*a* connects the fifth and sixth cams 60 and 70 and the second reverse guide groove 92*b* connects the sixth and seventh cams 70 and 80.

The start of the operation guide groove and the end of the reverse guide groove of the guide groove on any one of the cams at both ends of the variable valve unit may be on the same circumference, while the end of the operation guide groove and the start of the reverse guide groove on the other cam may be on the same circumference.

That is, with the cams shown in FIG. 3 as an example, the cams at both ends are the fifth and seventh cams 60 and 80, where the start A of the first operation guide groove 91*a* and the end B of the first reverse guide groove 92*a* are on the same circumference I, while the end H of the second operation guide groove 91*b* and the start G of the second reverse guide groove 92*b* are on the same circumference L.

The start of the operation guide groove and the end of another guide groove in the guide grooves on the cams inside the variable valve unit are on the same circumference, while the start of the operation reverse groove and the end of another reverse groove are on the same circumference, in which the circumferences are different.

That is, with the cams shown in FIG. 3 as an example, the inside cam is the sixth cam 70, and the start C of the second operation guide groove 91*b* and the end D of the first guide groove 91*a* are on the same circumference J, while the start E of the first operation groove 92*a* and the end F of the second operation groove 92*b* are on the same circumference K, in which the circumferences J and K are different.

The variable valve units 12 and 14 of the cylinder 200 may have different numbers of cams. That is, as shown in FIG. 1, the first variable valve unit 12 may include the first, second, third, and fourth cams 20, 30, 40, and 50 with different cam lobes and the second variable valve unit 14 may have the fifth, sixth, and seventh cams 60, 70, and 80 with different cam lobes, but the number of cams is not limited thereto and different numbers of cams may be provided, depending on the size of the variable valve units.

The cam lobes of the variable valve units 12 and 14 are different in lift and may be arranged in order of size or dimension. That is, as shown in FIG. 1, the lobes of the cams may have different sizes of lifts such that variable lifts can be implemented and may be sequentially arranged in order of size.

At least one cam in one of the variable valve units 12 and 14 provided for each cylinder 200 may have a cam lobe that is different in lift from any cam in the other valve unit or other valve units. For example, a cam in the first variable valve unit 12 has a cam lobe that is different in lift from any cam in the second variable valve unit 14. A cam in one of the variable valve units may have a cam lobe with a lift of zero (0), such that a CDA (Cylinder Deactivation) can be implemented.

Figure 5:
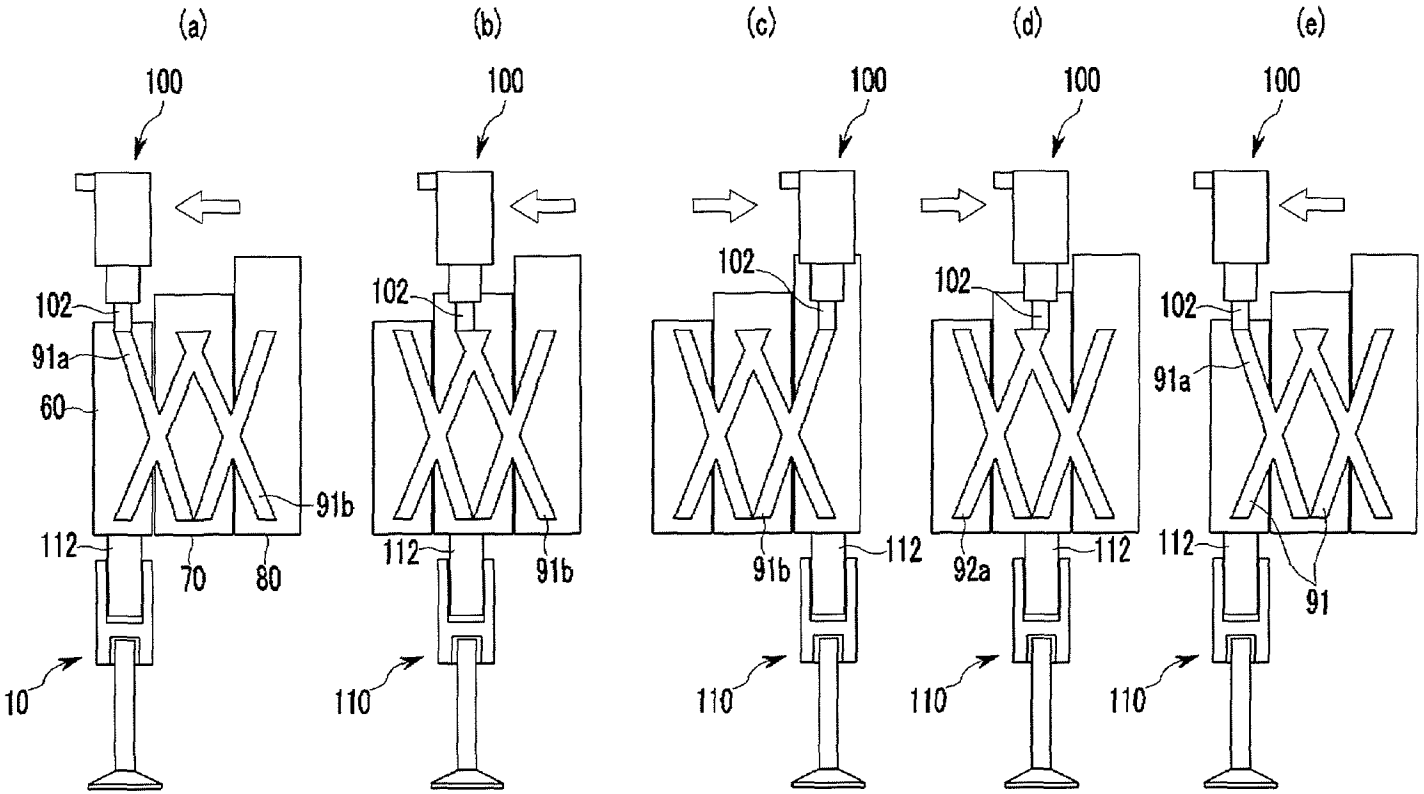
FIG. 5 is a view illustrating the operation of an exemplary multiple variable valve lift apparatus according to the present invention.

The valve opening/closing unit 110, as shown in FIG. 5, may include a roller 112 that comes in contact with the cams and the roller 112 comes in contact with any one of the cams, as the cams are moved by the solenoid valve 100.

Hereinafter, the operation of a multiple variable valve lift apparatus according to various embodiments of the present invention is described with reference to FIGS. 1 to 5. An ECU (Engine Control Unit) selects an operation mode of the variable valve lift apparatus and controls the solenoid valve 100 in accordance with the selected mode. The configuration and operation of the ECU, including the operation modes of the variable valve lift apparatus depending on the operation status of the engine are known in the art and thus the detailed description is omitted.

Referring to FIGS. 3 and 5, as the roller 112 comes in contact with the fifth cam 60 and the fifth cam 60 rotates, the valve opening/closing unit 110 opens/closes. As the solenoid valve 100 operates, as shown in FIG. 5(*a*), the actuating rod 102 is inserted into the start A of the first operation guide groove 91*a* and comes out from the end D of the first operation guide groove 91*a*. Accordingly, the fifth, sixth, and seventh cams 60, 70, and 80 are moved in the direction indicated in the figure, on the cam shaft 10.

In this position, as the solenoid valve 100 operates, as shown in FIG. 5(*b*), the actuating rod 102 is inserted into the start C of the second operation guide 91*b* and comes out from the end H of the second guide groove 91*b*. Accordingly, the fifth, sixth, and seventh cams 60, 70, and 80 are moved in the direction indicated in the figure, on the cam shaft 10.

In this position, as the solenoid valve 100 operates, as shown in FIG. 5(*c*), the actuating rod 102 is inserted into the start G of the second reverse guide 92*b* and comes out from the end F of the second reverse groove 92*b*. Accordingly, the fifth, sixth, and seventh cams 60, 70, and 80 are moved in the direction indicated in the figure, on the cam shaft 10.

In this position, as the solenoid valve 100 operates, as shown in FIG. 5(*d*), the actuating rod 102 is inserted into the start E of the first reverse guide 92*a* and comes out from the end B of the first reverse guide groove 92*a*. Accordingly, the fifth, sixth, and seventh cams 60, 70, and 80 are moved in the direction indicated in the figure, on the cam shaft 10, into the position shown in FIG. 5(*e*).

Thereafter, the variable valve lift apparatus repeats or performs those operations in accordance with the operation status or mode of the engine.

FIG. 6 is a diagram illustrating operation modes a multiple variable valve lift apparatus according to various embodiments of the present invention. By way of illustration, assuming that the variable valve unit 12 includes the first, second, third, and fourth cams 20, 30, 40, and 50 and the variable valve unit 14 includes the fifth, sixth, and seventh cams 60, 70, and 80, respectively, the lifts of the first, second, third, and fourth cams 20, 30, 40, and 50 are, for example, 0, 5, 8, and 10 mm, respectively, and the lifts of the fifth, sixth, and seventh cams 60, 70, and 80 are 0, 2, and 10 mm, the variable valve units 12 and 14 can provide or implement ten valve lift modes, as shown in FIG. 6.

That is, it is possible to implement various operation modes such as a CDA (Cylinder Deactivation) mode, an idle mode, a swirl mode, and a high-swirl mode performance mode, in accordance with the operation combination of the variable valve units 12 and 14.

Since the guide grooves for changing the valve lift are formed at the cam bases in the multiple variable valve lift apparatus according to various embodiments of the present invention, it is possible to achieve a compact multiple variable lift apparatus and it is correspondingly possible to implement relatively various operation modes in comparison to the size of cylinders, such that the fuel efficiency and the performance of an engine can be improved.

For convenience in explanation and accurate definition in the appended claims, the terms "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A multiple variable valve lift apparatus comprising:

a camshaft;

a plurality of cams slidably fitted on the camshaft and each having a cam base with a guide groove and a cam lobe;

a solenoid valve including an actuating rod capable of being selectively inserted into the guide groove of a cam in the plurality of cams; and a valve opening/closing unit capable of selectively coming in contact with any cam in the plurality of cams, wherein the plurality of cams, the solenoid valve, and the valve opening/closing unit constitute one variable valve unit, and two variable valve units are provided for one or each cylinder, and wherein the guide groove of one or each cam in the variable valve unit is formed at an angle to connect the cam bases of adjacent cams, and the guide groove includes an operation guide groove to move the cam in one direction and a reverse guide groove to move the cam in an opposite direction.

2. The apparatus of claim 1, wherein the variable units of the cylinder include different numbers of cams.

3. The apparatus of claim 1, wherein the cams of the variable valve units have cam lobes that are different in lift and the cams are arranged in order of size.

4. The apparatus of claim 1, wherein at least one of the cams in one of the two variable valve units provided for the cylinder has a cam lobe that is different in lift than any cam in the other variable valve unit.

5. The apparatus of claim 1, wherein one cam in the variable valve units has a cam lobe with a lift of zero (0).

6. The apparatus of claim 1, wherein the variable valve units of the cylinder operate independently from each other.

7. The apparatus of claim 1, wherein for a cam disposed at an end in the variable valve unit, a start of the operation guide groove of the cam is formed on a same circumference as an end of the reverse guide groove of the cam, and an end of the operation guide groove of the cam is formed on a same circumference as a start of the reverse guide groove of an adjacent cam.

8. The apparatus of claim 1, wherein for a cam disposed inside of the variable valve unit, a start of the operation guide groove of the cam is formed on a first circumference that is the same as an end of the operation guide groove of an adjacent cam, and a start of the reverse guide groove of the cam is formed on a second circumference that is the same as an end of the reverse guide groove of another adjacent cam, wherein the first and second circumferences are different.

9. The apparatus of claim 1, wherein the valve opening/closing unit includes a roller that comes in contact with any selected cam in the plurality of cams.

10. An engine equipped with the multiple variable valve lift apparatus of claim 1.

* * * * *